United States Patent [19]

Hechler, IV

[11] 4,270,701

[45] Jun. 2, 1981

[54] BUMPER

[76] Inventor: Valentine Hechler, IV, 26 Meadow View Rd., Northfield, Ill. 60093

[21] Appl. No.: 43,457

[22] Filed: May 29, 1979

[51] Int. Cl.[3] ..... B05B 15/06

[52] U.S. Cl. ..... 239/288.5

[58] Field of Search ..... 239/318, 288, 288.3, 239/288.5; 285/45; 138/109, 110

[56] References Cited

U.S. PATENT DOCUMENTS

| | | | |
|---|---|---|---|
| 868,311 | 10/1907 | White | 285/45 |
| 1,855,490 | 4/1932 | Rousek | 239/288.3 |
| 2,015,923 | 10/1935 | Davis | 239/288.5 |
| 3,052,488 | 9/1962 | Bruning | 285/45 |
| 3,938,550 | 2/1976 | Hechler | 239/318 |
| 4,146,058 | 3/1979 | Bercovitz | 138/110 |

FOREIGN PATENT DOCUMENTS

| | | | |
|---|---|---|---|
| 361967 | 1/1907 | France | 239/288.5 |

*Primary Examiner*—Johnny D. Cherry

*Attorney, Agent, or Firm*—Sixbey, Friedman & Leedom

[57] ABSTRACT

In the present invention a solution dispensing appliance such as a mixture proportioning spray gun made of molded plastic for consistent production accuracy of ratio mixing, lightness of weight and ease of handling, is provided with a resilient circular collar preferably carried at the end of the solvent supply hose where coupled to the gun which serves as an unobtrusive resilient bumper to engage the ground, or floor, if dropped, and to counteract, cushion, and protect the light molded gun against shattering impacts wherein the major effective weight of the falling hose filled with water on one side of the bumper collar is effective in counteracting and checking the downward momentum of the gun on the other side of the collar.

1 Claim, 3 Drawing Figures

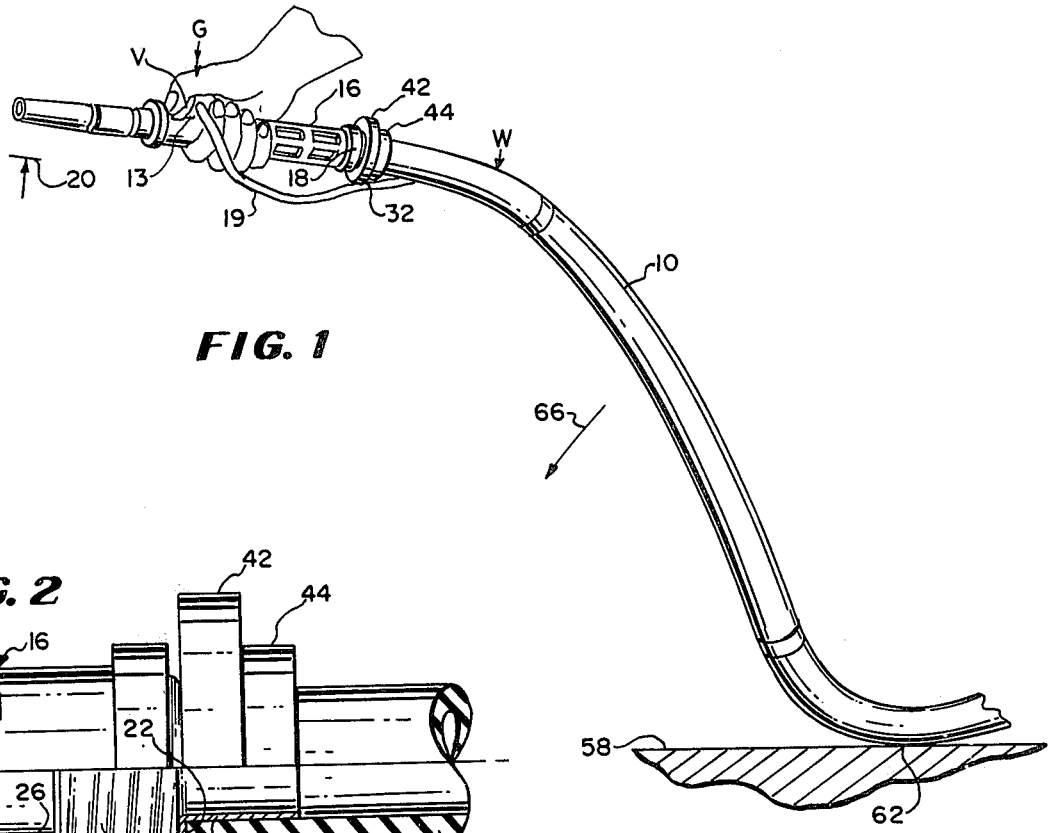
FIG. 1
FIG. 2
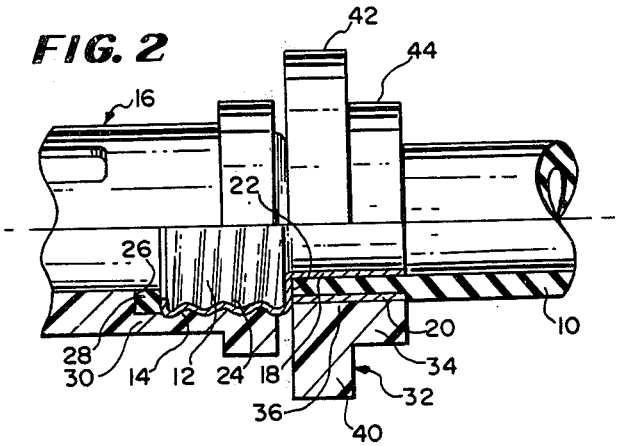
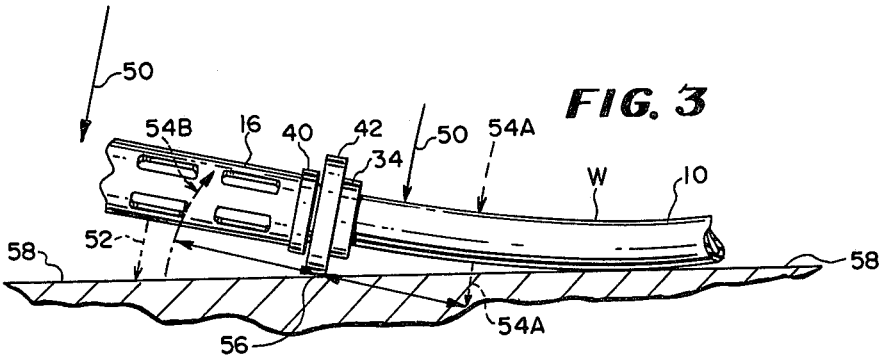
FIG. 3

BUMPER

BACKGROUND OF THE INVENTION

In providing accurate mixture proportioning and dispensing the gun is molded of plastic to assure exact proportioning dimesions, and is light enough to minimize fatigue in its use. The parts are preferably molded inexpensively of light materials such as high impact plastics which provide and maintain consistent performance accurate under temperature changes. However, these materials and parts are vulnerable to hard impacts, and damage, when connected to supply hoses and dropped onto the floor from above the waist level of the user.

If solute is supplied by a plastic bottle type container carried by the gun, the container can break the force of a fall, but where a solvent hose and one or more solute supply hoses are connected to a hand carried gun, such elimates the use of solute containers, but the weight of the supply hoses with liquids in them, particularly when touching the ground at a point remote from the gun will dominate its free falling movement, under gravity, in a relation wherein the free fall is accelerated downwardly and arcuately at the end of the hose in swinging movement about a point where the hose progressively touches the ground.

The gun strikes the floor with a whiplash effect often resulting in damage as distinguished from being dropped only a foot or so or laid down carefully. The plastic parts thereof may be damaged or broken, and, although the gun may still be capable of dispensing liquids, its operation, the critical flow rates and ratios may be adversely affected unknowingly.

SUMMARY OF THE INVENTION

In the present invention, the whipping force of the water hose upon a falling gun is utilized to divide and mutually counteract and terminate the downward movements of the gun and hose. A radially extending resilient ring at the end of the hose, moving with and extending substantially beyond its diameter serves as an impact fulcrum that divides the downward forces for mutual counteraction and termination of the downward movement of the gun and hose without damage to either one. The resilient fulcrum being movable with the elements, in their arcuate movement induced by gravity and the stiffness of the hose, is always ready for use at the critical moment and location. More particularly, the diameter, the shape and the location of the resilient bumper is such that the rigidly built gun is stopped in its downward movement and is slightly reversed in its movement by the downward movement of the hose action on the other side of the bumper which is rigidly secured to and is supported on the coupling between the hose and gun. A shattering impact contact of the gun on a floor or cement walk is thereby automatically minimized even if there is some contact under otherwise unusual conditions.

IN THE DRAWINGS

FIG. 1 diagrammatically shows the assembly embodying the invention in use.

FIG. 2 is an enlarged longitudinal section of the bumper assembly portion of the hose-to-gun connection.

FIG. 3 is a diagrammatic view indicating the forces successively involved when the invention which comes into action when the bumper hits the floor.

DESCRIPTION OF THE INVENTION

Referring now to the drawings in further detail, FIG. 2 is an enlarged section of a flexible garden type hose 10 terminally carrying a conventional male outlet connector 12 that is threaded into a female connector 14 rigidly supported on the inlet of a molded plastic mixing-dispensing gun 16 such as illustrated in detail in Hechler U.S. Pat. No. 4,010,768. The gun 16 is provided with a rigidly mounted water supply nipple 18 and one or more solute supply connections at 19, one being described, which, with the gun hand held at about the hip level 20 of a workman, is manually directed in all directions with the supply hoses extending to the ground for the performance and the purposes therein set forth.

Both of the two hose fittings illustrated herein include two elements (FIG. 2), the threaded male elements 12 and 13, each preferably secured to the end of a multilayer flexible garden hose 10 and the solute supply hose 19. The wall of the hose is clamped between element 18 on the member 12 located inside the end of the hose, and an external ferrule 20. The ferrule 20 is clamped on the outer surface of the hose 10 which thereby is suitably compressed radially to clamp the elements 18 and 20 on the hose 10 in permanent assembly against a shoulder 22. The larger male portion 12 of the fitting is threaded with a conventional garden hose male thread 24 thereon which terminates in an internal radial flange 26 engaging a conventional coupling hose washer 28 in sealed relation when secured to the gun.

The ferrule element 30 of the connection is carried by the gun for engaging the male thread 14 rotatably to hold the two threaded parts in tight axial alignment with the washer 28 compressed between them for relative rigidity with only slight resiliency remaining in the compressed washer to avoid rigid fragility.

A moderately resilient ring, preferably having a durometer reading between 40 and 50, has a hub portion 34 press-fitted tightly on an external radial reduced portion 36 of the male sleeve 18 where it rests snugly against the shoulder 22. A large diameter ring portion 40 thereof, preferably located adjacent to the gun 16 is provided which may be referred to as a bumper 40 having a major diameter at 42, of a size approximately three times the diameter of the hose 10, where it overlaps the coupling 18 and is disposed adjacent to the gun 16. The stepped hub portion 34 is about twice the size of the hose 18 and provides substantial lateral support for the large ring 40 against folding when contacting the floor 58. The hose preferably is a $\frac{3}{4}''$ hose with an inside diameter of $\frac{1}{2}''$. The axial thickness of the hub is $\frac{3}{4}''$ with the larger diameter ring portion 42 being $\frac{3}{8}''$ radially beyond the mating end of the gun 16.

FIG. 1 illustrates the gun in hand-held-use, and FIG. 3 illustrates the gun and hose as when falling after slipping out of the hand of the user. If the user is not holding the hose with his other hand, its resting engagement is with the floor 58 at 62. A falling gun then tends to follow an arcuate path 66 as the hose straightens horizontally while falling. Otherwise an unattached gun falling free from a person's hands is not likely to be damaged because of its lightness, and the resilient strength present in fabricated elements which would have more than enough body and strength to handle liquids under substantial pressures.

In this relationship, the composite longitudinal center of gravity of the assembly of the molded plastic mixing gun and the hoses which channel liquids is indicated at G on the gun side of the bumper and at W of the water hose system including the hub 44. The water hose is flexible but substantially stiff when subjected to full solvent pressure while the solute hoses are comparatively light and quite flexible under atmospheric pressure or less. The point W is preferably spaced a distance appreciably greater than G from the bumper 42.

When the gun is accidentally dropped from a distance approximately hip high, the thumb valve V is in its self-closed position and the flexible solute hoses 10 and 19 being flexible and unsupported at B provide very little downward drive on the gun at 13 such being freely movable theoretically under its own weight to engage the floor 58 with minimized effort upon the gun at 13.

However, since the water hose is under pressure and substantially stiffened therby as well as rigidly connected to the gun at the bumper 34, the falling force and whipping of the pressurized stiff hose at 10 will more than equal the forces at G, and upon engagement of the bumper 34 with the floor, the downward forces at W fulcrum downwardly about 34 and counteract with stiffness the downward forces at G and prevent damage to the gun contacting the floor. No shattering forces remain to damage the gun if it touches the floor only under its own static weight.

More particularly, in FIG. 3, the full arrows 50 indicate the effective action and energy directions developed in falling, and, dash line arrows 52 indicate what movements conventionally exist that could entail damage to the gun 16 without the bumper 40. The dot-dash arrows 54A and 54B indicate the resulting forces occurring as the bumper 40 reacts when engaged before the gun strikes the floor.

The reaction involves first a fulcrum action at 56 FIG. 3 to serve as a stop for the downward movement and energies that are effective on both sides of the fulcrum in the same downward direction. Momentarily they supplement each other downwardly and then, after the bumper 42 engages a stop, such as the floor 58, the energies oppose each other to substantially cancel out each other across the resilient bumper 40 through the rigid coupling at 22 and 24. Thus, a dropped hand-held gun does not come into damaging force-contact with a floor 58 when dropped. The primary expending energy at 54A develops a reverse upward force restraint at 54B against the gun contacting the floor when attached to the hose 10.

The location of the larger diameter of the bumper at 42 next to the gun serves its safeguarding purpose at the closest position possible to the gun so that if there is any falling dynamic imbalance between the hose and gun, it will favor the protecting of the gun against a free fall of the hose, and, if the gun slips out of the hand of a user, the energy involved is limited to the short distance of the fall.

Thus, the resilient bumper not only absorbs the shocks that would damage a gun from any height handled by a person, but does so automatically in the degree necessitated by a balancing of forces that reduces resulting forces to insignificance as far as damage to the gun is concerned, and, it is always in proper place on a hose even though the hose is used for hand controlled mobility.

What is claimed is:

1. The combination of a rigid, elongated, manually controlled liquid dispensing means having an inlet end and an outlet end, an elongated flexible liquid supply hose of substantially greater length than said liquid dispensing means which is adapted to extend from a horizontal support surface spaced beneath said liquid dispensing means to said inlet end when said liquid dispensing means is manually supported above said support surface, rigid coupling means extending between said liquid supply hose and said liquid dispensing means to rigidly, coaxially but releasably couple one end of said liquid supply hose to the inlet end of said liquid dispensing means, and a resilient bumper ring surrounding and extending over said rigid coupling means in the area where said rigid coupling means contacts said supply hose and abutting the inlet end of said liquid dispensing means when said liquid dispensing means is coupled to said supply hose, said resilient bumper ring having a major radial dimension which is greater than that of said liquid dispensing means and at least three times the diameter of the supply hose extending away from said coupling means and which is positioned closer to the center of gravity of said liquid dispensing means than to the center of gravity of the section of said supply hose adjacent said coupling means, the resilient bumper ring including a first circular section of said major radial dimension closely adjacent the inlet end of said liquid dispensing means and a second section of a lesser radial dimension than said first section but of a greater axial extent extending to a point adjacent said supply hose to supplement with said hose an opposing resilient weight leverage relation upon the bumper ring for urging the liquid dispensing means to reverse its downward movement and tilt upwardly about the major dimension of said first section when said first section contacts said support surface, the supply hose adjacent said coupling means in combination with said resilient bumper ring being of sufficient weight relative to the weight of said liquid dispensing means to pivot said liquid dispensing means about the fulcrum provided by said resilient bumper ring when said bumper ring initially contacts said support surface after said liquid dispensing means is allowed to free fall from a position above said support surface to move the outlet end thereof upwardly away from said support surface.

* * * * *